US007654206B2

(12) United States Patent
Saxton

(10) Patent No.: US 7,654,206 B2
(45) Date of Patent: Feb. 2, 2010

(54) CONTAINER SUPPORT CASTING FOR CORNER OF CONTAINER-CARRYING WELL CAR

(75) Inventor: Gregory J. Saxton, Portland, OR (US)

(73) Assignee: Gunderson, LLC, Portland, OR (US)

( * ) Notice: Subject to any disclaimer, the term of this patent is extended or adjusted under 35 U.S.C. 154(b) by 265 days.

(21) Appl. No.: 11/431,295

(22) Filed: May 9, 2006

(65) Prior Publication Data

US 2007/0261593 A1 Nov. 15, 2007

(51) Int. Cl.
*B61D 25/00* (2006.01)

(52) U.S. Cl. ..... 105/411

(58) Field of Classification Search ..... 105/238.1, 105/355, 359, 373, 396, 404, 411
See application file for complete search history.

(56) References Cited

U.S. PATENT DOCUMENTS

| | | | | |
|---|---|---|---|---|
| 2,194,356 | A | 3/1940 | Eklund | |
| 2,327,585 | A | 8/1943 | Ulrich | |
| 2,504,112 | A | 4/1950 | Dean et al. | |
| 3,389,663 | A | 6/1968 | Gutridge | |
| 3,520,256 | A | 7/1970 | Gutridge | |
| 3,659,724 | A | 5/1972 | Miller et al. | |
| 4,064,947 | A | 12/1977 | Cole | |
| 4,091,742 | A | 5/1978 | Cordiani | |
| 4,331,083 | A | 5/1982 | Landregan et al. | |
| 4,599,949 | A | 7/1986 | Hill | |
| 4,624,188 | A * | 11/1986 | Kaleta | 105/355 |
| 4,703,699 | A | 11/1987 | Hill | |
| 4,771,706 | A | 9/1988 | Lindauer et al. | |
| 4,782,762 | A | 11/1988 | Johnstone et al. | |
| 4,784,548 | A * | 11/1988 | Butcher et al. | 410/54 |
| 4,802,420 | A | 2/1989 | Butcher et al. | |
| 4,807,722 | A | 2/1989 | Jamrozy et al. | |
| 4,841,876 | A | 6/1989 | Gramse et al. | |
| 4,862,810 | A | 9/1989 | Jamrozy et al. | |
| 4,876,968 | A | 10/1989 | Lindauer et al. | |
| 4,889,055 | A | 12/1989 | Jamrozy et al. | |
| 4,893,567 | A | 1/1990 | Hill et al. | |
| 4,905,608 | A | 3/1990 | Terlecky et al. | |
| 4,909,157 | A | 3/1990 | Jamrozy et al. | |
| 4,911,082 | A | 3/1990 | Richmond | |
| 4,951,575 | A | 8/1990 | Dominguez et al. | |
| 5,054,403 | A | 10/1991 | Hill et al. | |
| 5,170,718 | A * | 12/1992 | Hill et al. | 105/404 |
| 5,279,230 | A | 1/1994 | Thomas et al. | |
| 5,423,269 | A | 6/1995 | Saxton et al. | |
| 5,465,670 | A | 11/1995 | Butcher | |

(Continued)

FOREIGN PATENT DOCUMENTS

| | | |
|---|---|---|
| DE | 3711409 | 10/1987 |

*Primary Examiner*—S. Joseph Morano
*Assistant Examiner*—Robert J McCarry, Jr.
(74) *Attorney, Agent, or Firm*—Chernoff, Vilhauer, McClung & Stenzel, LLP

(57) ABSTRACT

A railroad freight car that may include multiple units, including a container well for carrying intermodal freight containers in the body of at least one unit and with the body including container supports, located in the corners of the container well, that include a cast metal base welded to a side sill of the car. A container support tower also welded to the side sill extends upward from the base and may also be of cast metal.

28 Claims, 9 Drawing Sheets

U.S. PATENT DOCUMENTS

| | | | |
|---|---|---|---|
| 5,501,556 | A | 3/1996 | Butcher |
| 5,520,489 | A | 5/1996 | Butcher et al. |
| 5,730,063 | A | 3/1998 | Forbes et al. |
| 5,743,191 | A | 4/1998 | Coslovi |
| 5,749,686 | A | 5/1998 | Butcher et al. |
| 6,003,445 | A | 12/1999 | Coslovi et al. |
| 6,196,137 | B1 | 3/2001 | Forbes |
| 6,505,564 | B2 | 1/2003 | Khattab |

* cited by examiner

CONTAINER SUPPORT CASTING FOR CORNER OF CONTAINER-CARRYING WELL CAR

BACKGROUND OF THE INVENTION

The present invention relates to container-carrying railroad freight cars, and in particular relates to container-supporting structures located in the corners of a container well of such a railroad car unit.

Railroad cars including deep side sills defining container wells have been used for a number of years to carry intermodal cargo containers stacked in two tiers, with a pair of short containers loaded end-to-end in the container well, or a standard container such as a 40-foot long container carried in the well, and with a second-tier container at least 40 feet long carried on top of the container or containers in the well. Such cargo containers are built to a standard width, typically 8 feet, which must be accommodated between the side sills of the car that define the container well.

The containers in the well are supported at each end of the well by container support structures that, in one type of container car, have previously been built in the form of weldments of cut and bent steel plate welded to the lower portions of the side sills of the car. Such cargo container support structures have been undesirably expensive to build because of the amount of skilled labor required to weld the various parts together. Such welded assemblies also include surfaces that are difficult to reach for cleaning and preservation of the metal during the life of such a car. Some of the welds required to assemble the previously utilized cargo container support assemblies have been located where welds of the required quality are difficult to accomplish, and production costs are consequently higher than is desired.

What is desired, then, is an improved container carrying railroad freight car in which cargo container support structures are less expensive, more reliable, and lighter in weight than the previously utilized fabricated container support assemblies.

SUMMARY OF THE INVENTION

At least partially answering the desire for an improved railcar and cargo container support structure mentioned above, the cargo container support structures of the railroad freight car disclosed herein are at least partially of cast metal construction, as defined by the appended claims.

In one embodiment of the present invention a base portion of a container support structure is a unitary casting including reinforcing ribs on a lower side and having a container-carrying upper body portion.

In one embodiment of the base portion of a cargo container support structure as disclosed herein, reinforcing ribs extend along the underside of a horizontal upper body portion of the base, providing ample strength and stiffness of the base without the need for welding to build the reinforcing portions of the base.

In one embodiment of the cargo container support structures disclosed herein a tower of cast metal is welded to the case metal base, and the tower and the base are both welded to a side sill of a container well portion of a railroad freight car.

It is a feature of one embodiment of the container support that the tower portion includes one or more horizontal internal ribs.

The foregoing and other features and advantages of the invention will be more readily understood upon consideration of the following detailed description of preferred embodiments taken in conjunction with the accompanying drawings.

DETAILED DESCRIPTION OF PREFERRED EMBODIMENTS

Figure 1:
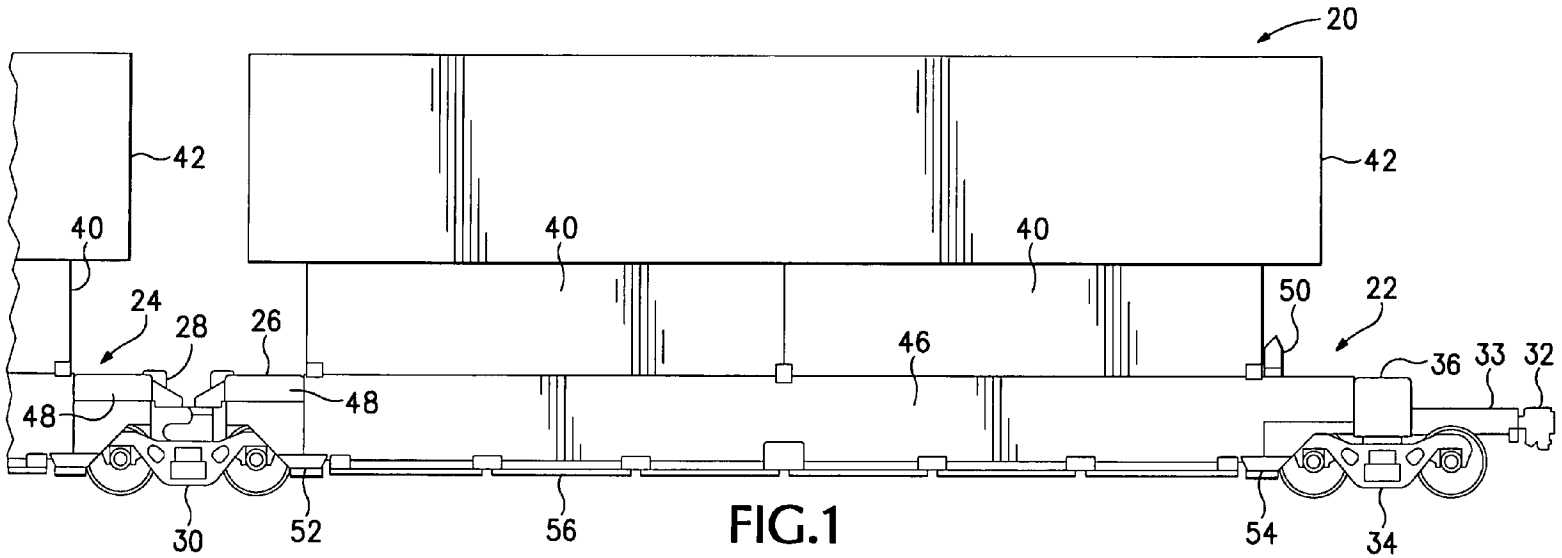
FIG. 1 is a side elevational view of a portion of a multi-unit railroad freight car including container wells for carrying intermodal freight containers.

Referring now to the drawings which form a part of the disclosure herein, a multi-unit container well car 20 shown in FIG. 1 includes an end unit 22 and at least one intermediate unit 24 of which a small part is shown, and typically would contain additional intermediate units 24 and an opposite end unit, not shown. An intermediate end 26 of the end unit 22 is coupled to an intermediate end 28 of the intermediate unit 24 through an articulating coupling, with both of those adjacent intermediate ends 26 and 28 of the end unit 22 and the intermediate unit 24 being supported on a shared wheeled truck 30.

A conventional coupler 32 mounted on the end unit 22 permits the multi-unit container well car 20 to be coupled to other railcars, and a wheeled truck 34 carries the conventional coupler end 33 of the end unit 22, whose body bolster 36 is carried conventionally atop the truck 34. Each of the units 22 and 24 of the well car 20 includes a container well 38 and can carry two or more intermodal freight containers, such as two nominal 20-foot containers 40 or one 40-foot container (not shown) carried within the container well 38, and a 45-foot container 42 stacked atop the 20-foot containers 40 in each of the container well car units 22 and 24.

Figure 2:
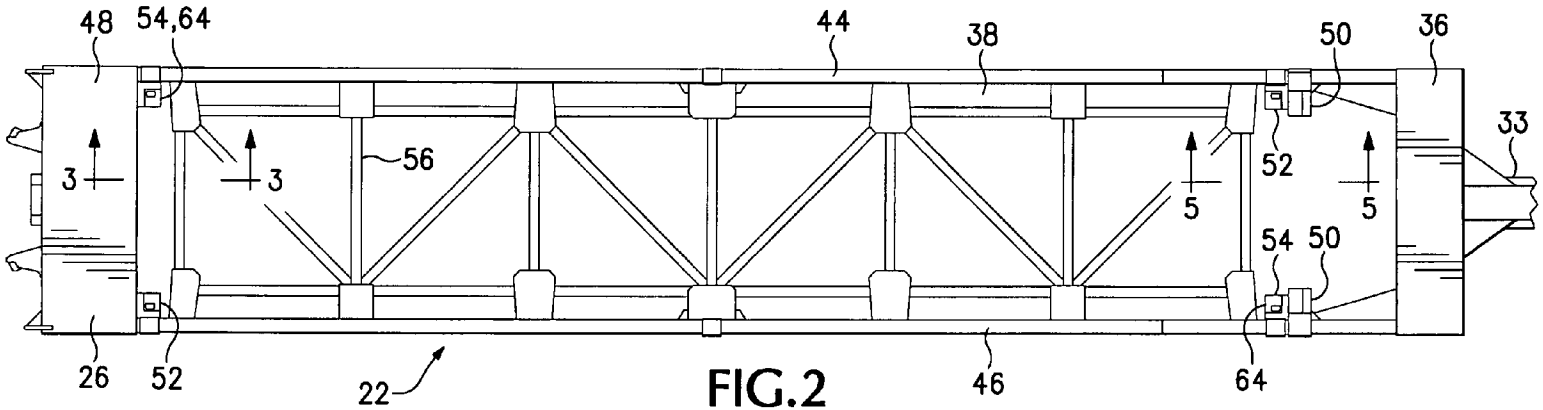
FIG. 2 is a top plan view of the body of the end unit of the freight car shown in FIG. 1.

The container well 38 is defined within each well car unit 22 or 24, as may be seen with respect to the end unit 22 in FIG. 2, by a pair of opposite side sills 44 and 46 which act as sides of the container well 38 and extend from the body bolster 36 at the conventional coupler end 33 to a body bolster 48 at the intermediate end 26. The side sills 44 and 46 may be of a type generally similar to that described in U.S. Pat. No. 4,599,949, but could be of other structural designs instead. Ends of the container well 38 are defined by the body bolster 48 at the intermediate end 26 of the end unit 22, and by container placement guides 50 mounted on the side sills 44 and 46, at a distance inboard from the body bolster 36 at the conventional coupler end 33, to provide room for the wheeled truck 34. Ends of container wells in the intermediate units 24 are defined by similar body bolsters 48 at each end of each intermediate unit 24.

Mounted on the side sills 44 and 46, at each end of the container well 42, are container support structures 52 and 54, located at respective corners of the container well to support the containers carried by the particular unit of the multi-unit car. The respective container support structures 52 and 54, located as shown in FIG. 2 at the opposite sides of the container well 42 at each end of the end unit 22, are all welded similarly to the side sills 44 and 46.

A bottom truss assembly 56 extends horizontally between the side sills 44 and 46 at the bottom of the container well 38 to provide lateral support at the bottom of each of the side sills 44 and 46 and act as emergency source of containment for a failed container 38.

Figure 4:
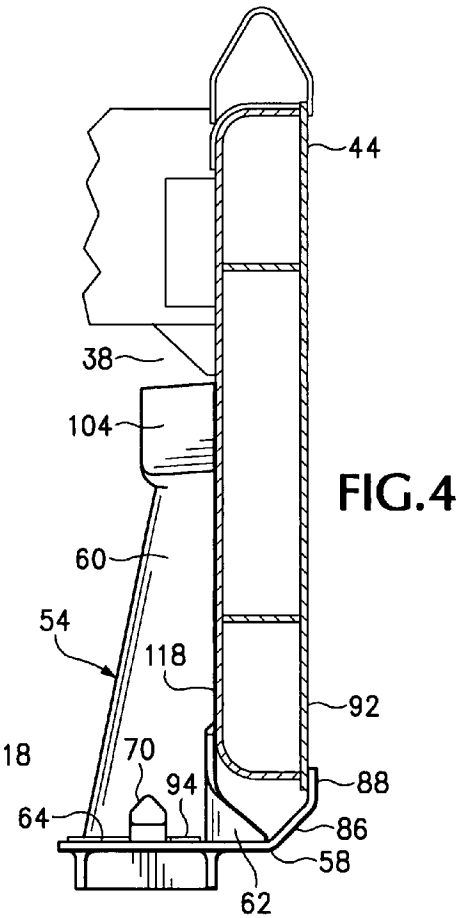
FIG. 4 is a sectional view taken along line 4-4 of FIG. 3, showing the container support structure shown in FIG. 3 and a side sill of the end unit.
Figure 3:
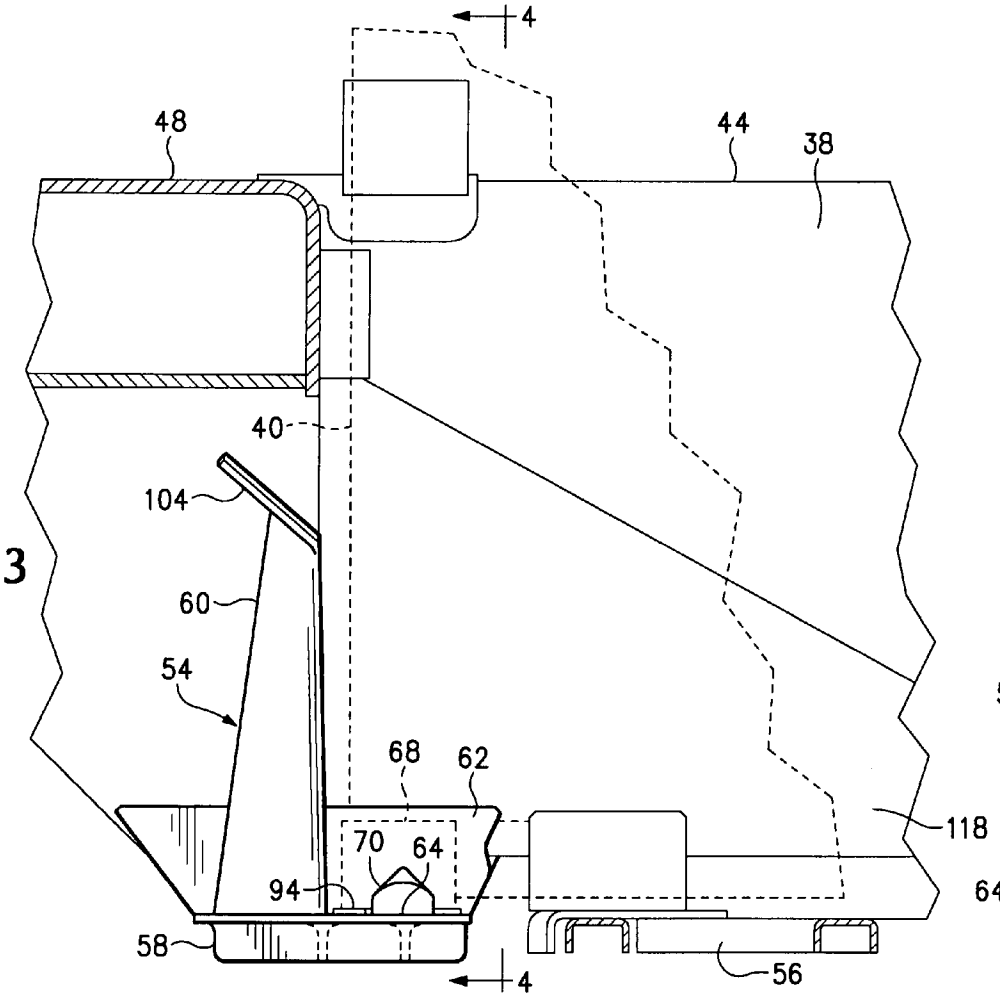
FIG. 3 is a view of a portion of the end unit shown in FIG. 2, taken along line 3-3 at an enlarged scale, and showing a left-hand container support structure at an end of the container well at the articulated end of the end unit.

As shown in greater detail in FIGS. 3 and 4, a left hand container support structure 54 as shown is an assembly including a container support base 58 of cast metal, such as a type AAR M201 Grade B+ weldable cast steel with a yield strength of at least 50,000 psi, for example. The base 58 is welded to the side sill 44. Mounted atop and extending upward from the base 58 is a container support tower 60, which is welded to the base 58 and also welded to the side sill 44. The container support base 58 and the container support tower 60 might also be combined in an integral casting. A longitudinal support plate 62 is welded to the top of the base 58, to the tower 60, and to the side wall 44. While the support plate 62 is shown herein as being formed of plate steel, such as ASTM 572 Grade 50 High Strength Low Alloy (HSLA) steel, it should be understood that it could also be cast as an integral part of the base 58.

The container support tower 60 is located beneath the intermediate end body bolster 48, as may be seen best in FIG. 3, and, along with the body bolster 48 the tower 60 defines the end of the container well 42 at the intermediate end 26 of the car unit 22. Extending into the container well, as may be seen in FIGS. 2, 3, and 4, a container carrying portion 64 of the container support base 58 is located so as to receive and support a corner of a cargo container 38 shown in phantom view in FIG. 3. A corner casting 68 of the container 38, also shown in phantom view, is held in the required location by a container stacking cone 70.

Figure 5:
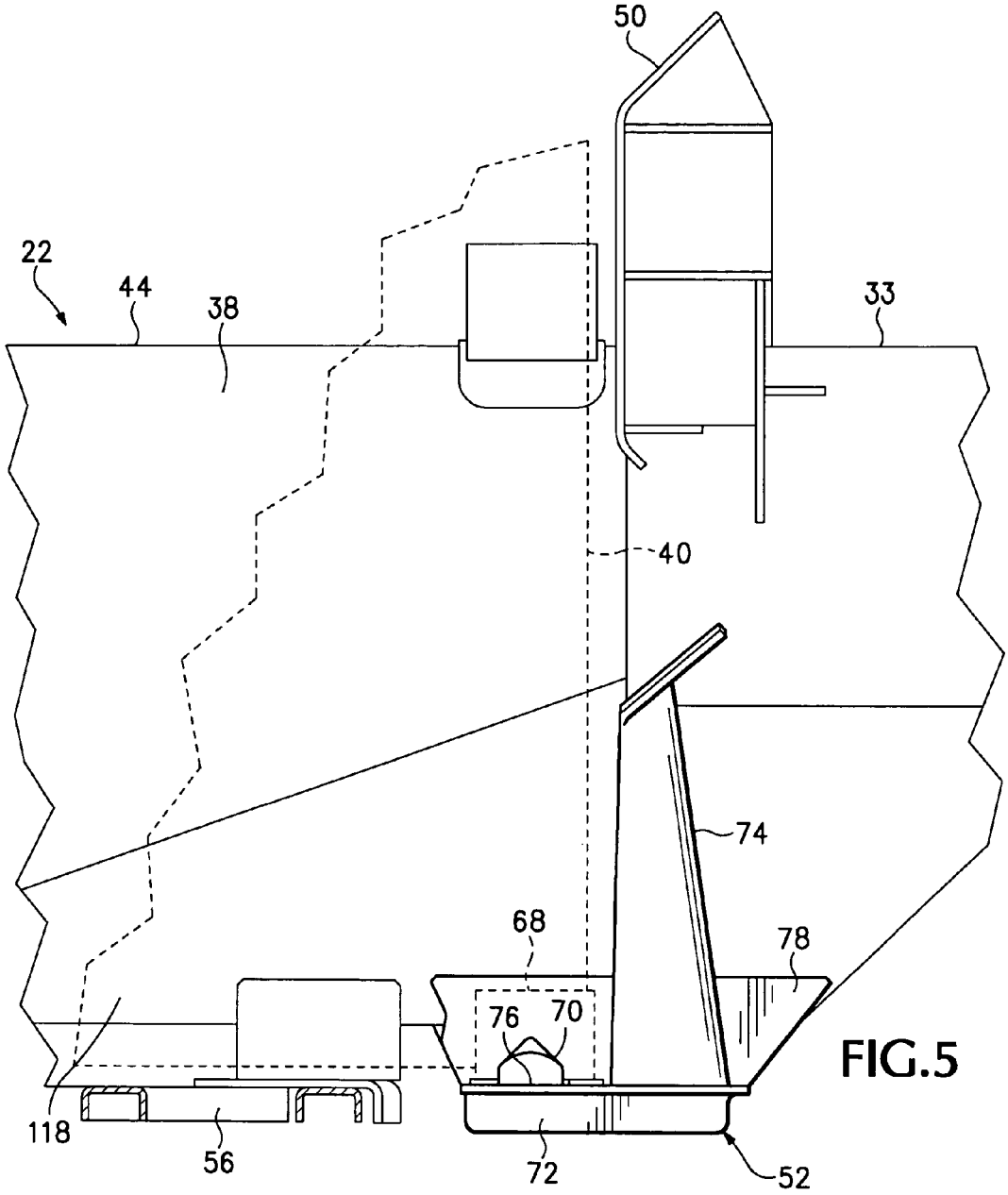
FIG. 5 is a view of a portion of the end unit shown in FIG. 2, taken along line 5-5 at an enlarged scale, and showing a container support structure of right-hand configuration, mounted at the opposite end of the container well from the container support structure shown in FIGS. 3 and 4, adjacent the conventional coupler end of the freight car.

Referring to FIG. 5, a right-hand container support structure 52 is essentially a mirror image opposite of the left-hand container support structure 54 shown in FIGS. 3 and 4, and is similarly attached to the side sill 44 of the end unit 22, at the outer, or conventional coupler, end 33 of the end unit 22. The right-hand container support structure 52 includes a base 72 that is a mirror image opposite of the base 58 of the support structure 54, and a container support tower 74 that similarly is a mirror image opposite of the tower 60. A stacking cone 70 is similarly located on a container carrying portion 76. A longitudinal support plate 78 may be welded to or cast with the base 72 and the container support tower 74 and is welded to the side sill 44.

The container support tower 74 is located beneath the container placement guide 50 at the conventional coupler end 33 of the car unit 22, as shown in FIG. 5, and the left-hand container support structure 54, located on the opposite side of the conventional coupler end unit 22 as shown in FIG. 2, is similarly located with its tower 60 beneath the respective container placement guide 50. Since the container support structures 52 and 54 are essentially alike except being opposite-handed, references made to the container support structure 54 shown in FIGS. 6-13 are applicable also to corresponding parts of the container support structure 52.

Figure 6:
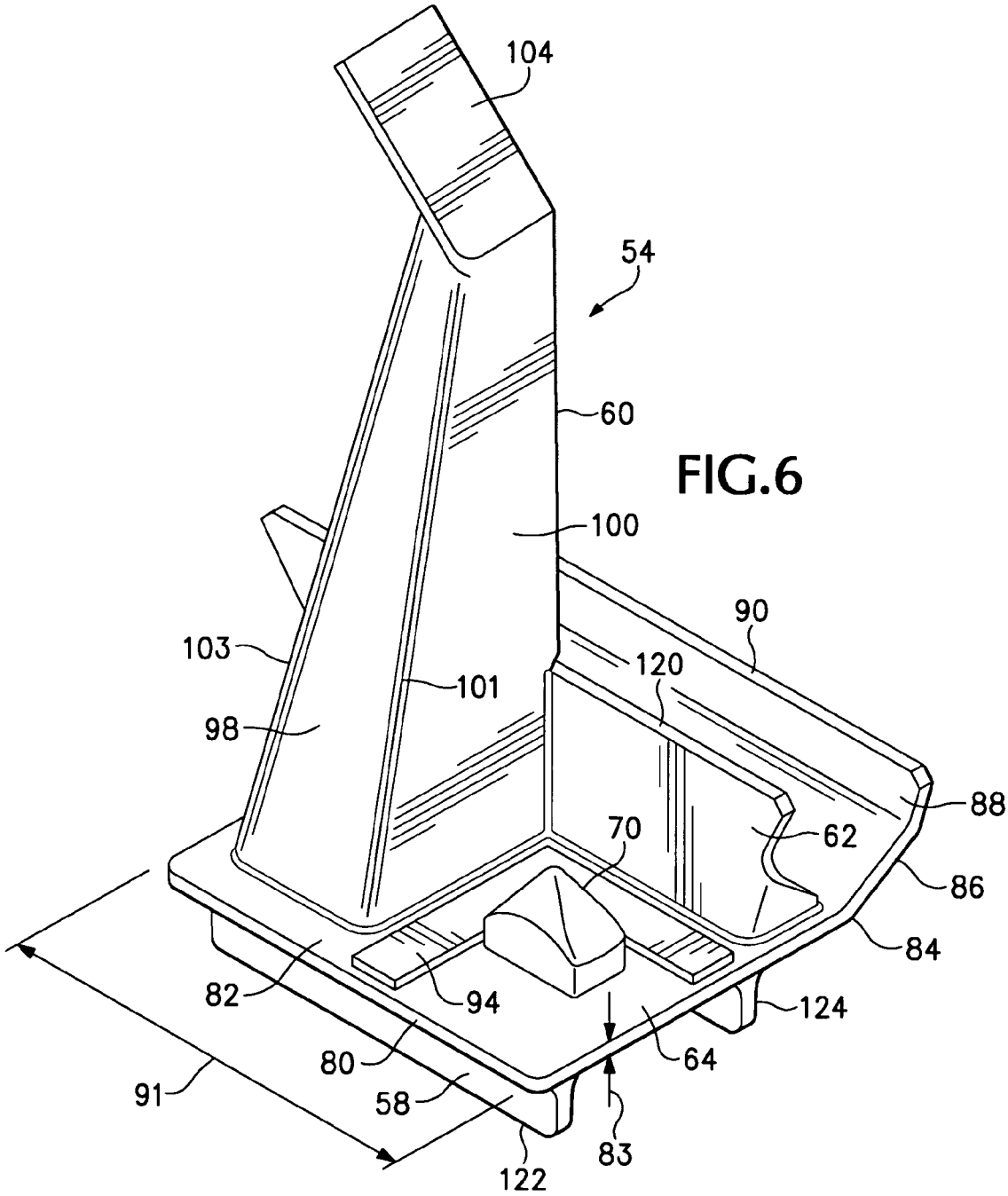
FIG. 6 is an isometric view taken from above and to the left, or inboard side, of a left-hand container support structure such as that shown in FIGS. 3 and 4.
Figure 7:
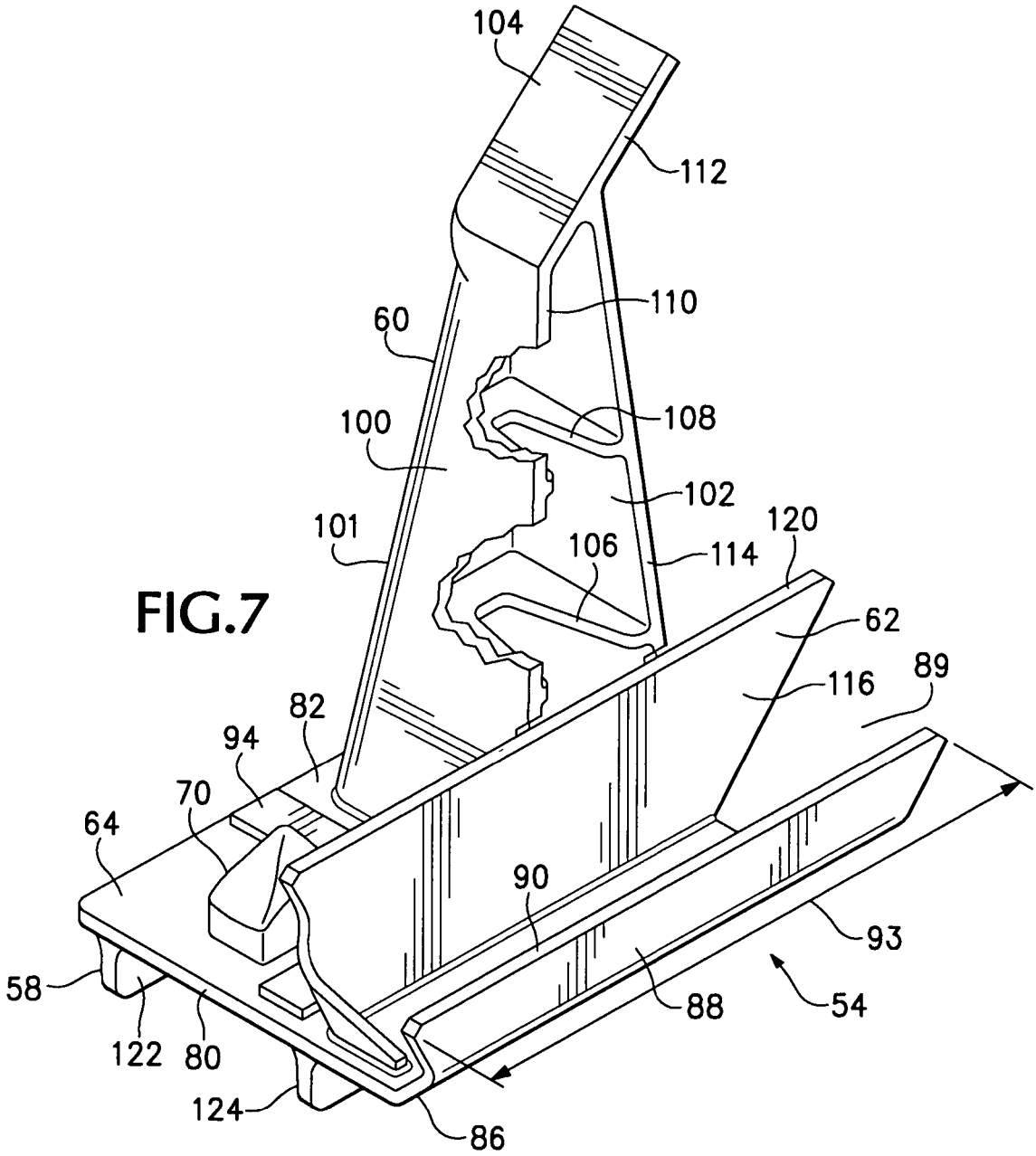
FIG. 7 is a partially cutaway isometric view taken from above and to the right, or outboard, side of the container support structure shown in FIG. 6.
Figure 10:
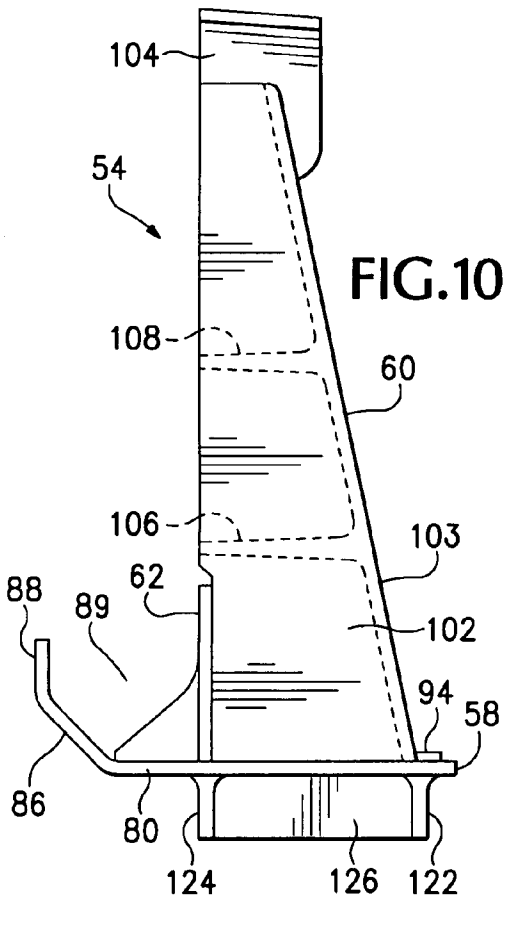
FIG. 10 is an elevational view of the container support structure shown in FIGS. 6-10, taken in a direction from outboard the end and parallel with the length of the side sill of a container well in which the container support structure would be mounted, as indicated by the line 10-10 in FIG. 9.
Figure 9:
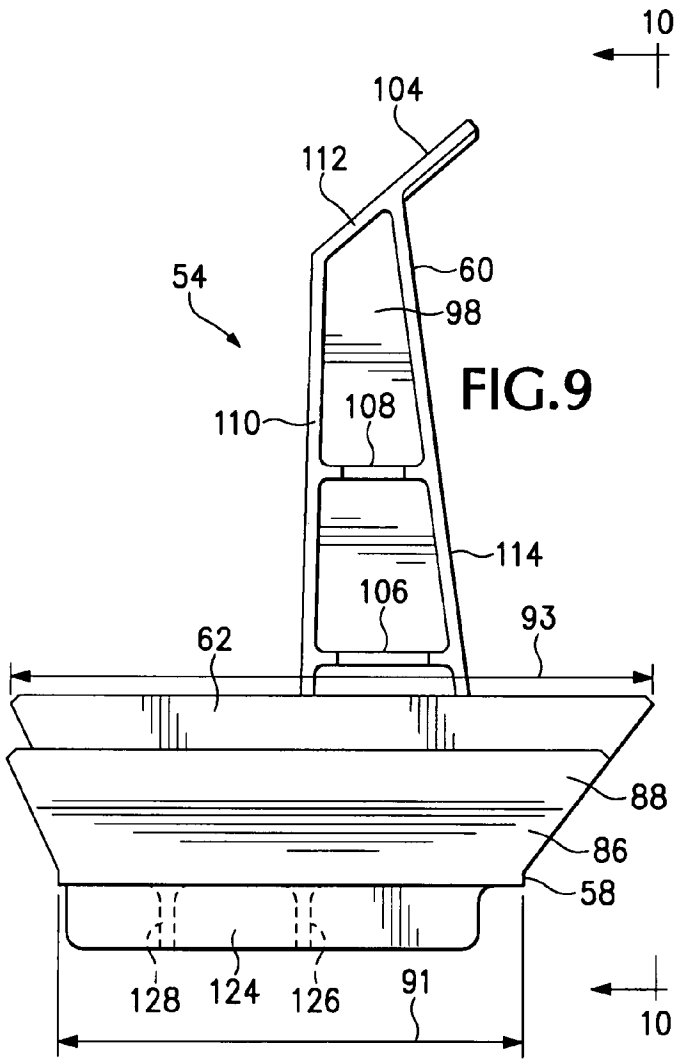
FIG. 9 is an elevational view of the container support structure shown in FIGS. 6 through 8, taken in an inboard-looking direction as indicated by line 9-9 in FIG. 8.
Figure 8:
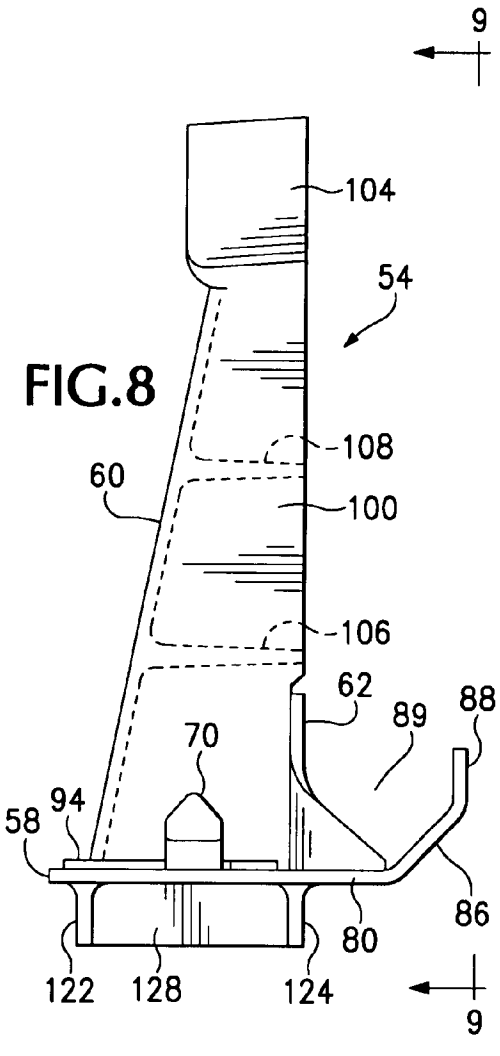
FIG. 8 is an elevational view of the container support structure shown in FIGS. 6 and 7 taken in the direction of line 4-4 in FIG. 3.

Referring next to FIGS. 6 and 7, the base 58 of the left-hand container support structure 54 has a horizontal, plate-like upper body portion 80 that includes a top face 82 that is generally planar as shown herein. While this may be the simplest form in which to cast the base 58 it will be understood that the tower-supporting part of the base 58 need not be flat. Thus the base 58 and the tower 60 could have complementary forms, somewhat different than shown, and the top face 82 need not extend beneath the tower 60 in a planar form. The horizontal upper body portion 80 may have a thickness 83 of, for example, ⅝ inch, in order to have ample strength.

Extending diagonally upward and outboard from an outboard lateral margin 84 of the top face 82 is a mounting flange 86 that includes a vertical upper portion 88. An upwardly open channel 89 is defined between the mounting flange 86 and the longitudinal support plate 62, and the lower portion of the side sill 44 is received in the channel 89. The thickness of the vertical upper portion 88 of the mounting flange 86 may be less than the thickness of the lower, diagonal portion thereof and of the horizontal upper body portion 80, in order to avoid unnecessary weight. A top margin 90 of the mounting flange 86 extends horizontally and is welded to the outer plate 92 of the side sill 44. In the embodiment shown, the horizontal upper body portion 80 has a length 91 of about 17⅜ inches, while the mounting flange 86 has a length 93 of about 23 inches, along its vertical upper portion 88, in order to distribute the loads carried by cargo container support structures 52 and 54 over a large area of the side sill 44 or 46 of the well car unit 22.

An L-shaped load distribution plate 94 which may be made of steel is welded to the top face 82 to contact the corner casting 68 and thus to apply vertical loads, imposed on the container carrying portion 64 by the bottom corner casting 68 of a container 40, close to the container support tower 60 and the longitudinal support plate 62 or a corresponding portion of an integrally cast base 58.

Figure 13:
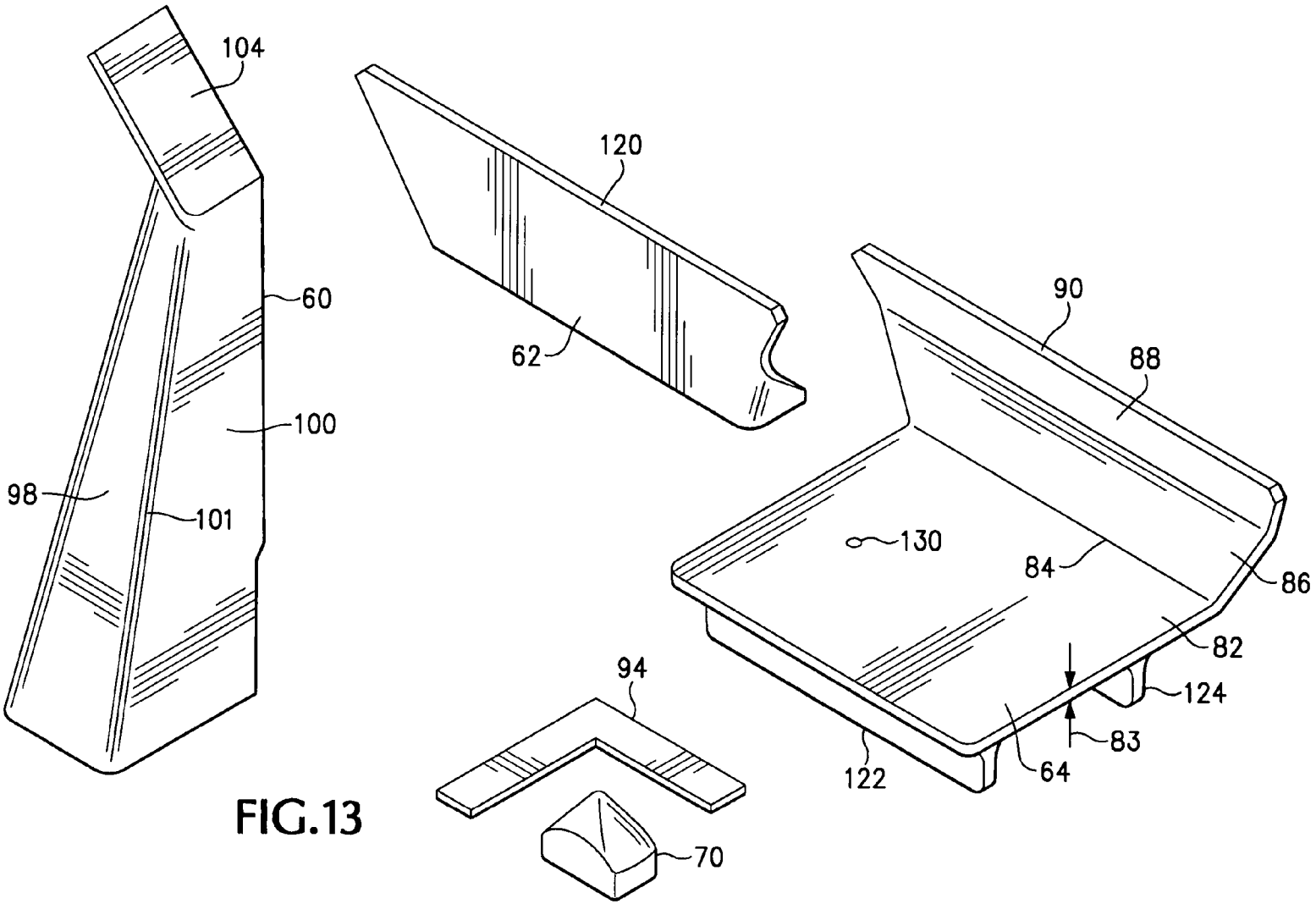
FIG. 13 is an exploded isometric view of the container support structure shown in FIGS. 6-12.
Figure 14:
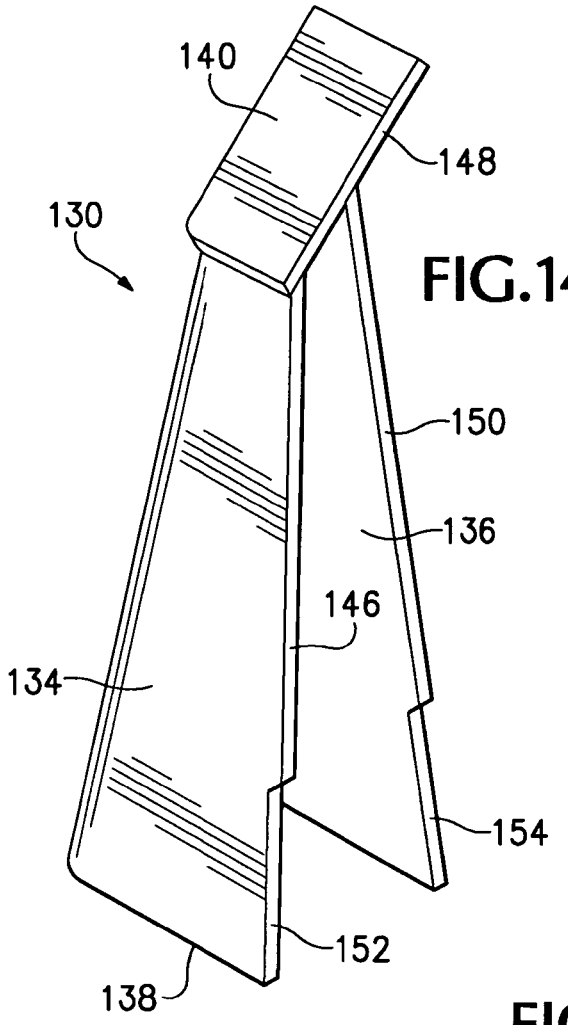
FIG. 14 is an isometric view from above and to the right, or outboard, side of a tower that is an alternative embodiment of one aspect of the container support structure shown in FIGS. 6-13.
Figure 15:
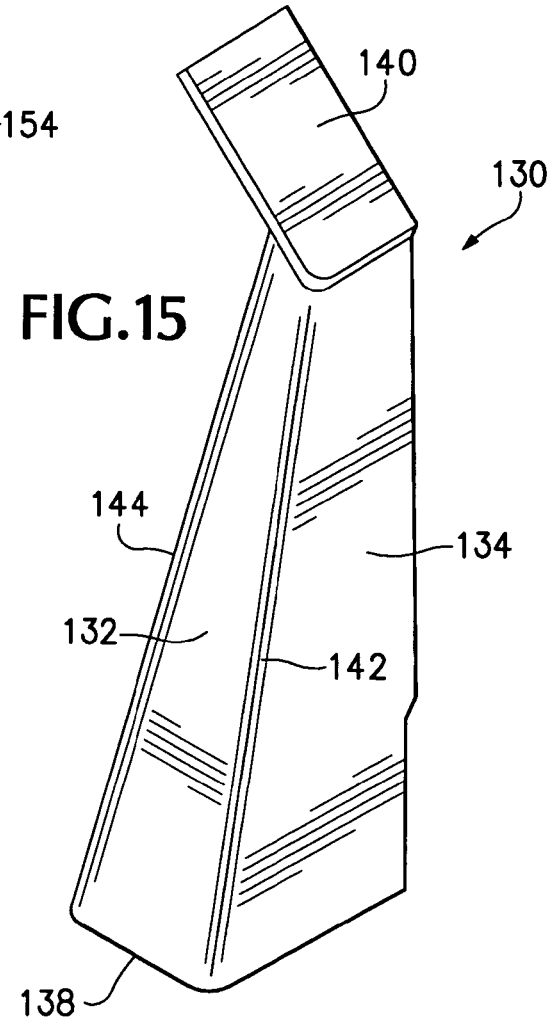
FIG. 15 is an isometric view from above and to the left, or inboard, side, of a tower which is an alternative embodiment of one aspect of the container support structure shown in FIGS. 6-13.

While a container support tower of a container support structure 52 or 54 including a cast base 58 or 72 may be made as a weldment of formed steel plate, as shown in FIGS. 14 and 15, the towers 60 and 74 as shown in FIGS. 6-13 herein are formed as castings. Each tower 60 or 74 includes three upstanding generally planar walls, an inboard lateral wall 98 facing toward the opposite side sill, a laterally extending wall 100 facing into the container well 38, and a longitudinally facing outboard wall 102. These three walls 98, 100, and 102 are tapered, from a greatest width at the bottom of the tower 60, where it is welded to the base 58, to a least width at the upper end of the tower, where a guide plate 104 is mounted. The walls 98, 100, and 102 are interconnected with each other through rounded edges 101 and 103 in a generally U-shaped configuration, open as an outboard lateral side of the tower, toward the longitudinal support plate 62 and the side sill 44 or 46 to which it is attached, and closed at the top by the guide plate 104. The guide plate 104 slopes downwardly and longitudinally into the container well 38, so that a container being loaded into the container well and coming into contact with the guide plate 104 will slide down along the guide plate 104 into the desired location within the container well 42. The guide plate 104 also acts as a convenient extension by which to grasp and hold the container support tower 68 during installation of the container support structure 52 or 54 in a car.

In the container support tower 60 as shown a pair of reinforcing ribs 106 and 108, cast integrally with the walls 98, 100, and 102, extend horizontally inward from the walls at respective intermediate positions along the height of the tower 60. That is, the reinforcing rib 106 is spaced upwardly above the bottom of the tower 60 and the top face 82 of the base 58, and the upper reinforcing rib 108 is located between the guide plate 104 and the lower rib 106, as may be seen in FIGS. 7, 8, 9, and 10.

As may be seen by reference to FIGS. 4, 7, 8, and 9 an outboard margin 110 of the wall 100, an outboard margin 112 of the guide plate 104, and an outboard margin 114 of the wall 102 are coplanar with the outboard face 116 of the longitudinal support plate 62, and fit against a planar portion of the inner plate 118 of the side sill 44. The container support structure 54 is welded to the inner plate 118 along the margins 110, 112, and 114 as well as along the upper margin 120 of the longitudinal support plate 62. Thus the container support tower 60 and the longitudinal support plate 62 interconnect the base 58 with the side sill 44 to carry the weight of a container 38 to the car body 22.

Figure 11:
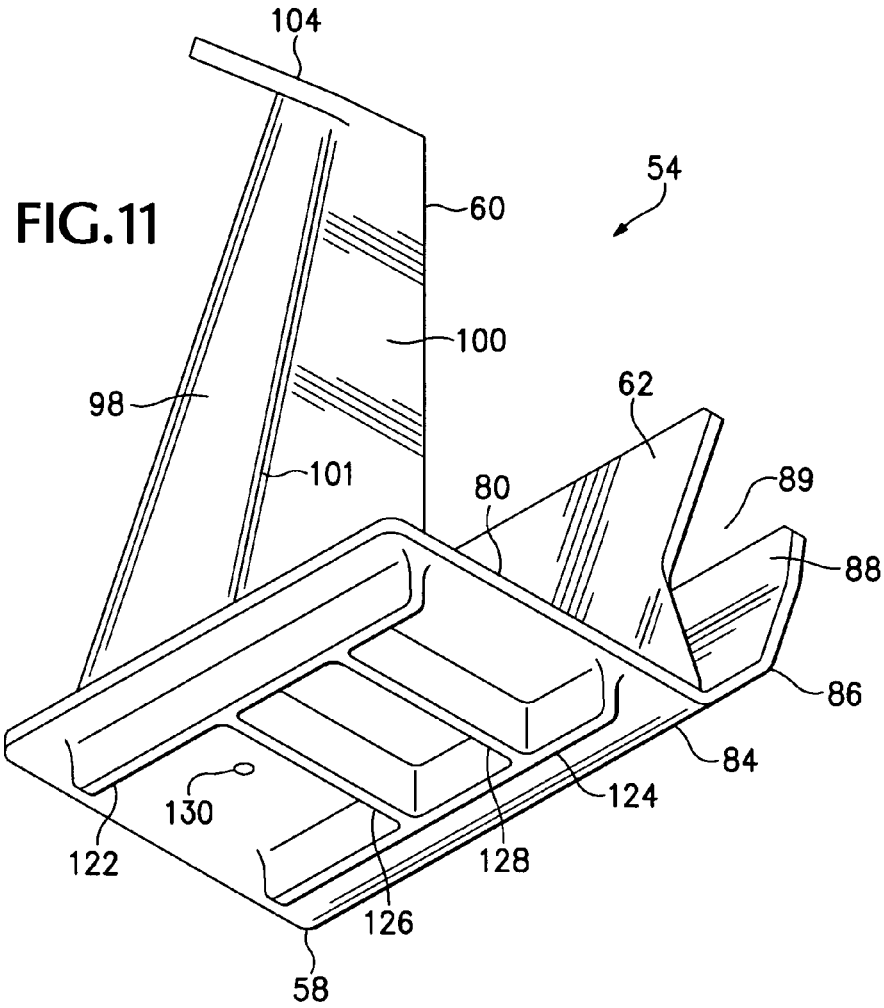
FIG. 11 is an isometric view taken from below and to the left, or inboard, side of the container support structure shown in FIGS. 6 through 10.
Figure 12:
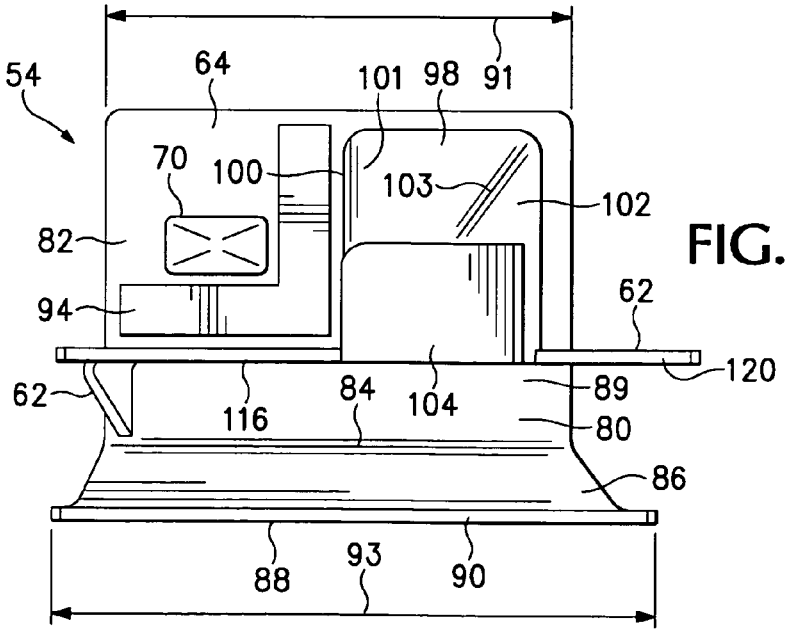
FIG. 12 is a top plan view of the container support structure shown in FIGS. 6-11.

The container support base 58 incorporates reinforcing portions, including a pair of ribs 122, 124 that extend longitudinally along the underside of the horizontal upper body portion 80, as seen best in FIG. 11. The rib 122 extends beneath and parallel with the bottom end of the inboard lateral wall 98 of the tower 60, while the rib 124 extends parallel with and beneath the bottom of the longitudinally extending support plate 62.

A shorter rib 126 extends transversely, parallel with and beneath the bottom of the laterally extending wall 100 of the tower 60, and is interconnected at its ends with the longitudinally extending ribs 122 and 124. Another shorter rib 128 may extend transversely between the longitudinal, longer, ribs 122 and 124 at a location centrally beneath the container stacking cone 70, reinforcing the container carrying portion 64 of the container support base 58, as may also be seen in FIG. 12. The reinforcing ribs 122, 124, 126, 128 are shaped to merge with the underside of the top portion 80 of the base 58 with a generous radius. For example, the ribs 122, 124, 126, and 128 may be ½ inch thick at their bottom margins and may extend downward about 2¼ inch beneath the upper body portion 80 to ensure ample strength and provide appropriately stiff support beneath the container carrying portion 64.

The several components of the left-hand container support structure 54 are shown in exploded view in FIG. 13, where it may also be seen that a drain hole 130 is provided in the upper body portion 80, extending through the upper body portion 80 beneath the tower 60, to allow for drainage of any water which may enter into the tower.

By constructing the container support structures 52 and 54 with at least the bases 58 and 72 made as castings, and with the towers 60 and 74 optionally also as castings or even as a casting integral with the bases, significant savings in labor costs can be effected, without adding to the weight of a complete railroad car including such cargo container support structures 52 and 54 and without sacrificing load bearing characteristics of the container support structures 52 and 54. There are fewer and simpler welds to be made in assembling the container support assemblies 52 and 54 and no greater difficulty in mounting the container support structures 52 and 54 onto the side sill structures 44 and 46 of a well car than with the container support assembly previously fabricated of welded plate steel.

Many of the advantages of the structures disclosed above are still available in container support structures 52 and 54 incorporating the tower 130 of formed plate steel shown in FIGS. 14 and 15. The container support tower 130 or a mirror image opposite thereof (not shown) may be made as a weldment of formed steel plate that includes three upstanding generally planar walls, an inboard lateral wall 132 to face toward the opposite side sill, a laterally extending wall 134 facing into the container well 38, and a longitudinally facing outboard wall 136. These three walls 132, 134, and 136 are tapered, from a greatest width at the bottom 138 of the tower 130, where it would be welded to the base 58, to a least width at the upper end of the tower 130, where a guide plate 140 is mounted. The walls 98, 100, and 102 are interconnected with each other where the plate is bent, forming rounded edges 142 and 144, in a generally U-shaped configuration, open as an outboard lateral side of the tower 130, toward the longitudinal support plate 62 and the side sill 44 or 46 to which it would be attached, and closed at the top by the guide plate 140, also of steel plate. The guide plate 140 also acts as a convenient extension by which to grasp and hold the container support tower 130 during installation of the container support structure 52 or 54 in a car.

As in the tower 60 an outboard margin 146 of the wall 134, an outboard margin 148 of the guide plate 140, and an outboard margin 150 of the wall 136 would fit against a planar portion of the inner plate 118 of the side sill 44. Lower outboard margins 152 and 154 would fit against the longitudinal support plate 62, leaving its outboard face 116 coplanar with the outboard margins 146, 148, and 150, so as to fit against the inner plate 118.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A container support structure for a railroad freight car, comprising:

(a) a container support base of cast metal and including an upper body portion having a top face, a mounting flange extending from a longitudinally extending lateral margin of said upper body portion, and a reinforcing portion beneath said upper body portion and cast integrally therewith;

(b) a container support tower located on and extending upward from said container support base;

(c) a longitudinal support plate located atop said upper body portion of said base and extending along an outboard lateral side of said container support tower; and (d) wherein said container support tower has three upstanding side walls interconnected with each other and arranged in an open-sided U-shaped configuration facing openly toward said longitudinal support plate.

2. The container support structure of claim 1 wherein said container support tower is of cast metal.

3. The container support structure of claim 1 wherein said container support base and said container support tower are both included in an integral casting.

4. The container support structure of claim 1 wherein said longitudinal support plate is an integrally cast portion of said container support base.

5. The container support structure of claim 1 wherein respective margins of two of said three side walls of said container support tower are welded to said longitudinal support plate.

6. The container support structure of claim 1 wherein said longitudinal support plate is welded to said container support base adjacent said mounting flange thereof.

7. The container support structure of claim 1 wherein said mounting flange and said longitudinal support plate cooperatively define an upwardly open channel.

8. A container support structure for a railroad freight car, comprising:

(a) a container support base of cast metal, said container support base including an upper body portion having a top face, a mounting flange extending from a longitudinally extending lateral margin of said upper body portion, and a reinforcing portion beneath said upper body portion, said upper body portion, said mounting flange, and said reinforcing portion all being cast integrally as parts of said container support base:

(b) a container support tower located on and extending upward from said container support base, said container support tower having three upstanding side walls arranged in an open-sided U-shaped configuration;

(c) wherein said container support tower includes two internal reinforcing ribs, said ribs each extending horizontally inward within said tower from one of said side walls, and said ribs being spaced upwardly apart from one another within said container support tower, a lower one of said ribs being spaced upwardly apart from said container support base and an upper one of said ribs being spaced downwardly apart from an upper end of said container support tower; and (d) wherein said container support tower, including said reinforcing ribs, is an integral casting.

9. A container support structure for a railroad freight car, comprising:

(a) a container support base of cast metal and including an upper body portion having a top face, a mounting flange extending from a longitudinally extending lateral margin of said upper body portion, and a reinforcing portion beneath said upper body portion and cast integrally therewith;

(b) a container support tower located on and extending upward from said container support base; and (c) wherein said reinforcing portion of said container support base includes a pair of downwardly extending longer ribs spaced apart from each other, and also includes at least one downwardly extending shorter rib extending between and interconnected with both of said longer ribs.

10. The container support structure of claim 9 wherein said longer ribs are oriented parallel with each other and with an upper part of said mounting flange.

11. The container support structure of claim 9 wherein respective portions one of said longer ribs and one said shorter rib are located beneath and aligned with respective portions of said container support tower.

12. The container support structure of claim 9 wherein one said shorter rib is located beneath a container carrying portion of said upper body portion of said container support base.

13. A railroad freight car for carrying containers, comprising:

(a) a car body supported by wheeled trucks and having a pair of opposite side sills defining a container well extending longitudinally of said car body, said container well having a pair of opposite ends;

(b) a pair of container support structures located at one of said opposite ends of said container well, a respective one of said container support structures being mounted on each of said side sills;

(c) at least one said container support structure including a container support base of cast metal and including an upper body portion having a top face, a mounting flange extending upward from a longitudinally extending lateral margin of said upper body portion, and a reinforcing portion beneath said upper body portion and cast integrally therewith;

(d) a container support tower located on and extending upward from said container support base, said container support tower having three upstanding side walls interconnected with each other and arranged in an open-sided U-shaped configuration facing openly toward said longitudinal support plate; and (e) said container support structure including a longitudinal support plate located atop said upper body portion of said base and extending along an outboard lateral side of said container support tower.

14. The freight car of claim 13 wherein said container support tower is of cast metal.

15. The freight car of claim 13 wherein said container support base and said container support tower are both included in an integral casting.

16. The freight car of claim 13 wherein said longitudinal support plate is an integrally cast portion of said container support base.

17. The freight car of claim 13 wherein respective margins of two of said three side walls of said container support tower are welded to said longitudinal support plate.

18. The freight car of claim 13 wherein said longitudinal support plate is welded to said container support base adjacent said mounting flange thereof.

19. The freight car of claim 13 wherein said mounting flange and said longitudinal support plate cooperatively define an upwardly open channel.

20. A railroad freight car for carrying containers, comprising:

(a) a car body supported by wheeled trucks and having a pair of opposite side sills defining a container well extending longitudinally of said car body, said container well having a pair of opposite ends;

(b) a pair of container support structures located at one of said opposite ends of said container well, a respective one of said container support structures being mounted on each of said side sills;

(c) at least one said container support structure including a container support base of cast metal and including an upper body portion having a top face, a mounting flange extending upward from a longitudinally extending lateral margin of said upper body portion, and a reinforcing portion beneath said upper body portion and cast integrally therewith; and (d) a container support tower located on and extending upward from said container support base, said container support tower having three upstanding sides arranged in an open-sided U-shaped configuration.

21. The freight car of claim 20 wherein said container support tower includes at least one internal reinforcing rib.

22. The freight car of claim 21 wherein said internal reinforcing rib extends horizontally inward within said tower from one of said side walls of said container support tower.

23. The freight car of claim 22 wherein said container support tower, including said internal reinforcing rib, is an integral casting.

24. The freight car of claim 23, said container support structure thereof including two said internal reinforcing ribs spaced upwardly apart from one another within said container support tower, a lower one of said internal reinforcing ribs being spaced upwardly apart from said container support base and an upper one of said internal reinforcing ribs being spaced downwardly apart from an upper end of said container support tower.

25. A railroad freight car for carrying containers, comprising:

(a) a car body supported by wheeled trucks and having a pair of opposite side sills defining a container well extending longitudinally of said car body, said container well having a pair of opposite ends;

(b) a pair of container support structures located at one of said opposite ends of said container well, a respective one of said container support structures being mounted on each of said side sills;

(c) at least one said container support structure including a container support base of cast metal and including an upper body portion having a top face, a mounting flange extending upward from a longitudinally extending lateral margin of said upper body portion, and a reinforcing portion beneath said upper body portion and cast integrally therewith, said reinforcing portion of said container support base including a pair of downwardly extending longer ribs spaced apart from each other, and at least one downwardly extending shorter rib extending between and interconnected with both of said longer ribs; and (d) a container support tower located on and extending upward from said container support base.

26. The freight car of claim 25 wherein said longer ribs of said reinforcing portion of said container support base are oriented parallel with each other and with an upper part of said mounting flange.

27. The freight car of claim 25 wherein respective portions of one of said longer ribs and one said shorter rib of said reinforcing portion of said container support base are located beneath and aligned with respective bottom end portions of said side walls of said container support tower.

28. The freight car of claim 25 wherein one said shorter rib of said reinforcing portion of said container support base is located beneath a container carrying portion of said upper body portion of said container support base.

* * * * *